United States Patent [19]

Cucksey

[11] Patent Number: 4,880,210

[45] Date of Patent: Nov. 14, 1989

[54] REMOVABLE AND STACKABLE HOISTWAY DOOR ASSESMBLY

[75] Inventor: Fred Cucksey, Belmont, Calif.

[73] Assignee: Specialty Hoisting Services, Inc., Newark, Calif.

[21] Appl. No.: 153,228

[22] Filed: Feb. 8, 1988

[51] Int. Cl.[4] ..... E04H 17/16

[52] U.S. Cl. ..... 256/26; 256/27; 256/73; 256/DIG. 6; 160/351; 52/70; 52/71

[58] Field of Search ..... 256/25, 26, 24, 27, 256/73, DIG. 6; 52/30, 70, 71, 108, 66, 730; 160/351; 292/254; 108/53.1; 49/464

[56] References Cited

U.S. PATENT DOCUMENTS

| | | | |
|---|---|---|---|
| 806,343 | 4/1905 | Haver | 256/27 |
| 2,820,256 | 1/1958 | Dahl | 52/70 |
| 3,611,762 | 11/1971 | McBurnie | 292/254 X |
| 3,766,959 | 10/1973 | Himsl | 160/351 X |
| 4,742,653 | 5/1988 | Napier et al. | 52/66 |

*Primary Examiner*—Randolph A. Reese
*Assistant Examiner*—Franco Deliguori
*Attorney, Agent, or Firm*—Douglas A. Chaikin

[57] ABSTRACT

Disclosed herein is a hoistway door assembly for use with temporary hoists. The assembly includes a center member pivotable about either a first or a second axis. The center member is latchable from either the front or back sides and has stacking portions. The assembly includes wing members rotatable about the first or second axis and being interchangeable with one another. The wing members have stacking portions for mateable connection with the center member stacking portions. The center member is symmetrical about its horizontal centerline and the stacking portions are also symmetrical about the center member vertical centerline. The wing members stacking portions are likewise symmetrical about the vertical wing members centerline.

19 Claims, 4 Drawing Sheets

10'
38
14
30
50
20
4
12

REMOVABLE AND STACKABLE HOISTWAY DOOR ASSESMBLY

BACKGROUND OF THE INVENTION

1. Field of the Invention:

This invention relates generally to temporary hoistway assemblies which are removable and more particularly to hoistway assemblies which have left and right wing panels and which are portable and stackable.

2. Previous Art:

Temporary man lifts are used on construction sites for delivering men and material to a particular location. In order to build the steel concrete superstructure of buildings, men and material must be transported to one floor after the other. A temporary hoist is particularly useful for accomplishing this job. These man lifts must have hoistway door on each floor which include a door and preferably side panels.

A typical hoist assembly provides a door and occasionally, right and left wing panels to offer some protection from the moving man lift. The door is hingedly connected to the wing panels with one side opening, like a standard door. Studs are attached to the superstructure of each floor and the man lift assembly is attached to the studs. The door typically has a latch which can open only from the side of the hoist and not from the side of the superstructure. It would be quite unsafe to provide a latch on the superstructure side because a workman could inadvertently open the door and fall, severely injuring himself.

A temporary hoist assembly is either purchased or made on site and fixed to each floor of the superstructure as needed. In some large buildings there may be multiple man lifts and a hoist assembly is needed for each stop which is typically each floor.

Typical hoist assemblies are made from wood and are very heavy. The wooden hoist assembly may exceed 500 or more pounds with both a left and a right handed wing panel. It will be appreciated that transporting such heavy hoist assemblies from one site to another is difficult and expensive. The alternative of making new hoist assemblies for each site is equally unattractive, since that takes time and energy away from the building project itself.

Additionally when hoist assemblies are moved from site to site, they are quite cumbersome. Loading and unloading the wooden hoist assemblies is made even more difficult since the wood tends to be slippery and the door and side panels slide with respect to one another making transport and loading and unloading a time consuming and even hazardous operation.

After the hoist assembly is brought to a site it must be unloaded and assembled. Typically, a hoist assembly with wing panels has different right and left wing panels so that each panel may lift and rotate properly with relation to the door panel. The workman must sort the panels of the assemblies into doors, left panels and right panels. After sorting the doors and panels, the proper nuts and bolts must be found as well as the correct hinge assemblies. After finding the proper assembly equipment, the workman can then transport this heavy hoist assembly to the floor desired and start the assembly operation.

What is needed is a lighter weight hoist assembly that is easy to transport and assemble and which is easy to remove and stack for storage and transport.

SUMMARY OF THE INVENTION

It is an object of this invention to provide a relatively lightweight hoist assembly that requires only a minimum of time to assemble.

It is a further object of this invention to provide such a hoist assembly which can be stacked and easily loaded for transport from one site to another.

It is a further object of this invention to provide such a hoist assembly which is removable with a minimum of time and effort.

In accordance with the above objects and those that will be mentioned and will become apparent below that a hoist assembly in accordance with the instant invention is provided which comprises:

a center member pivotable about a first or second axis, the center member having latch means for latching or unlatching the center member and the center member having stack means for stacking multiple hoist door assemblies which is symmetrical along the vertical centerline when the center member is upright; and first and second wing members, the first and second wing members being pivotable about the first and the second axis, the wing members being able to pivot such that each wing member contacts the center member at its limit of rotation, the wing members being interchangeable, and each wing member having stack means for stacking multiple hoist door assemblies compatible with the center member stack means.

It is also within the scope of the instant invention to provide a hoist assembly which comprises:

a center member having pivot means for pivoting about a first or a second axis, the center member having latch means for latching or unlatching the center member from either side of the center member and the center member having symmetrical stack means for stacking multiple hoist door assemblies;

first and second wing members, the first and second wing members each having pivot means for pivoting about the first or the second axis and means for interconnecting the center member pivot means, the wing members being able to pivot such that each wing member contacts the center member at the wing member's limit of rotation, each wing member having stack means for stacking multiple hoist door assemblies compatible with the center member stack means and the wing members being interchangeable; and a top member adjacent to one end of the center member and spanning the distance between the side members, the top member having connecting means for connection to each of the side members, thereby, when assembled each of the members connect with one another and the side members are interchangeable and the center member may be opened from either side.

In a preferred embodiment of the invention, all of the members are non-foldable and made from a material in the family of engineering plastics and particularly polypropelyne.

In still another preferred embodiment the center member has a width of W and each of the wing members have a width of approximately ½W. Thus when the wing members are folded against the center member, the wings are within the width W of the center member and may be efficiently stacked and stored or transported with ease. It is also preferable to have the wing members identical to one another. This reduces the cost of manufacture and relieves the workman of finding left and right members.

It is an advantage of this invention to provide a hoist assembly which is economical to transport from one site to another.

It is an additional advantage of this invention to provide a hoist assembly which is economical to manufacture and assemble.

Further objects and advantages of this invention will become clearer with reference to the description of the invention with respect to the drawing.

DETAILED DESCRIPTION OF THE INVENTION

Figures 1, 1A:
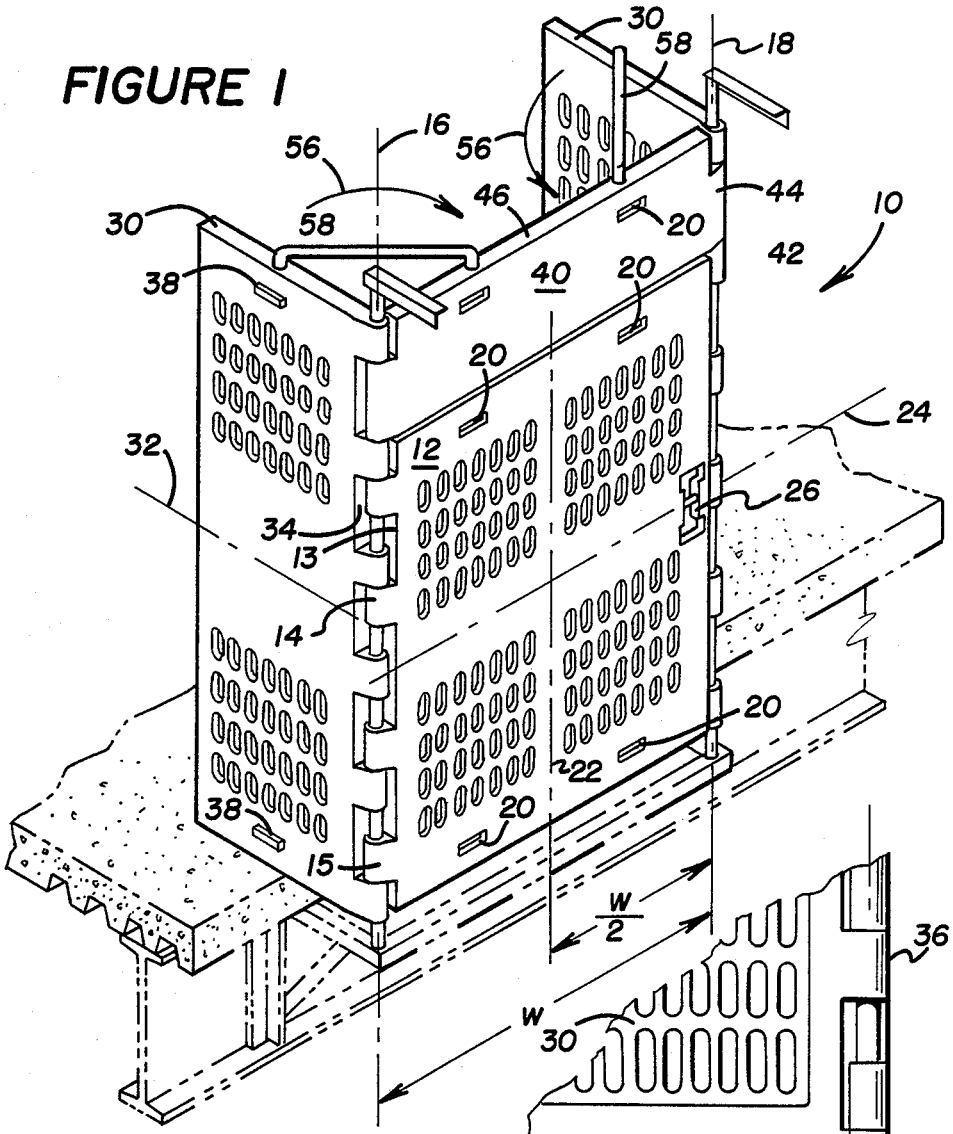
FIG. 1 is a perspective view of a hoist door assembly in accordance with this invention.
FIG. 1A is a side partial sectional enlarged view illustrating the connection of the hoist door assembly of FIG. 1 with the building and the hoist.
Figure 2:
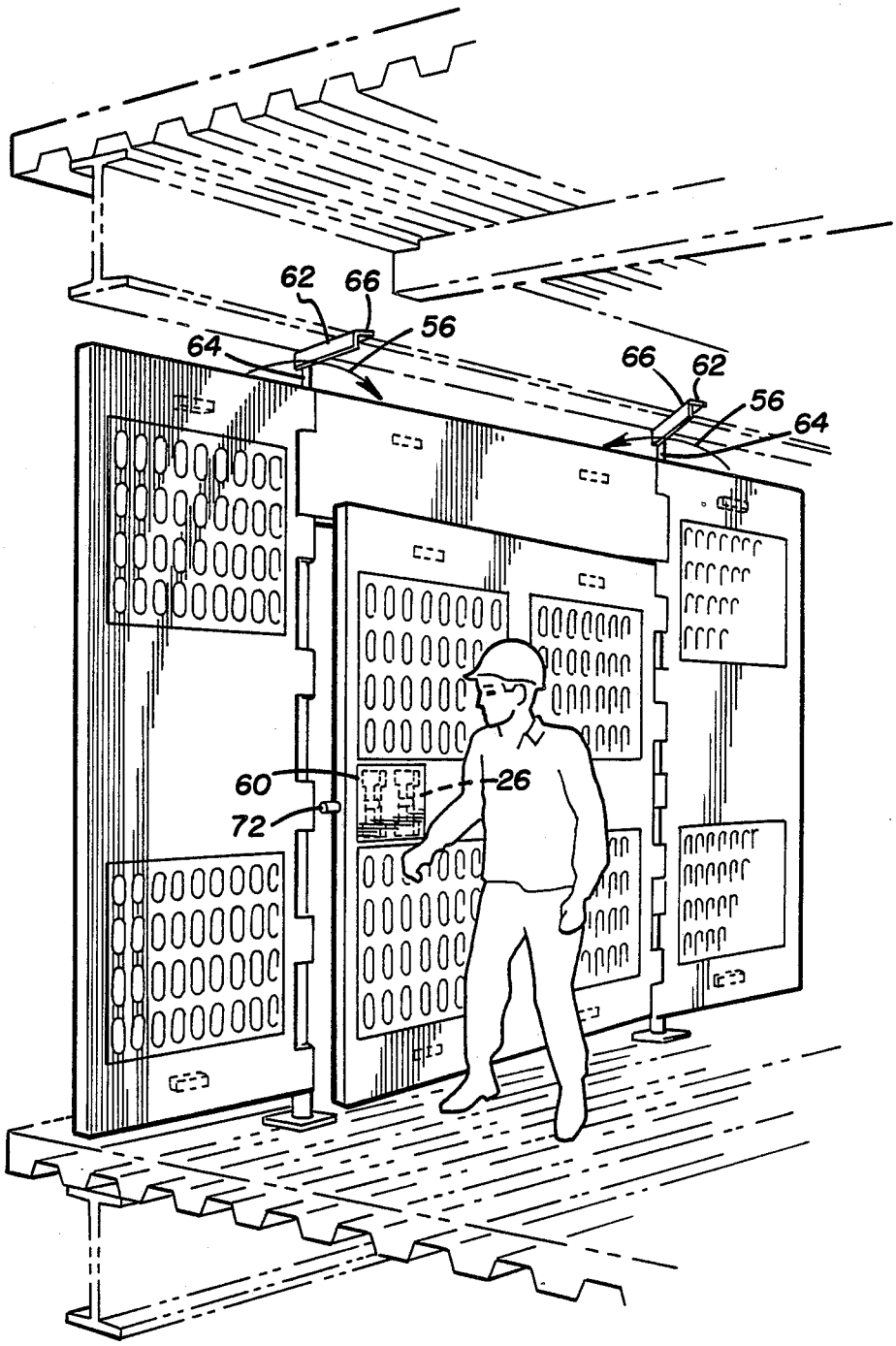
FIG. 2 is a plan view of the hoist door assembly of FIG. 1 illustrating the instant invention in use.

The invention will now be described with reference to the drawing wherein like reference characters designate like or corresponding parts throughout the several views. Referring particularly to FIGS. 1 and 2, there is shown the invention, a hoist door assembly, generally indicated by numeral 10.

The hoist door assembly 10 includes a center member 12 defining a door. The center member 12 has one side 13 with a hinge structure 14 having a plurality of hinge portions 15 for pivotal rotation around either a first axis 16 or a second axis 18. The hinge structure 14 is symmetrical about a horizontal centerline 24. As will be appreciated more fully hereinafter, this enables the center member 12 to serve as either a right or a left handed door without affecting the operation of the hoist door assembly 10 in accordance with the invention or the ability to stack and store multiple hoist door assemblies.

The center member 12 has a width W measured from the hinge structure 14 to the opposite side.

The center member 12 has two pair of female stacking portions 20 comprising indentations in the face of the center member 12 which are symmetrical about a vertical centerline 22 and the horizontal centerline 24. One pair of female stacking portions 20 are never used. In this way, the center member 12 may be turned upside down or have the position of the hinged side 13 interchanged with the unhinged side.

The center member 12 has a door latch 26. The center member 12 may be latched and unlatched from either the front or back side using the door latch 26 which is more fully explained with reference to FIGS. 5 and 6.

The hoist door assembly 10 includes a pair of wing members 30 which are pivotable about the first axis 16 and the second axis 18. The wing members 30 are identical and may be used interchangeably with one another. The wing members 30 are symmetrical about a horizontal centerline 32.

One side of the wing member 30 has a hinge structure 34 comprising hinge portions 36 which are designed for compatible mating with center member 12 hinge structure 14 and hinge portions 15.

The wing members 30 have a width approximately ½W measured from the hinge structure 34 to the opposite edge. Thus, the wing members 30 may be folded against the center member 12 for storage and transportation.

The wing members 30 have male stacking portions 38 located adjacent either end of the wing member. The male stacking portions 38 are symmetrical about a vertical center line (not shown) and are designed for mating with the female stacking portions 20, again this is to insure interchangeability of each of the wing members.

It will be appreciated that the wing sections 30 may be used interchangeably, since the hinge structure 34 is symmetrical about the horizontal centerline 32 and the stacking portions 38 are symmetrical about both the horizontal and the vertical centerlines.

It will further be appreciated that since the wings 30 are identical, time is saved in assembly since the workman does not have to be concerned with left and right hand wings and costs are saved in manufacturing since only one wing member is ever made.

A top member 40 is positioned adjacent the center member 12 top edge 42 and spans the distance between the wing members 30. The top member 40 has a hinge portion 44 at either side for compatible connection with each of the wing members 30. The top member 40 also includes a pair of female stacking portions 20 adjacent the top member 40 top end zone 46 and symmetrical with respect to the vertical centerline 22. The top member 40 female stacking portions 20 are aligned with the other stacking portions 20 of the center member 12 and with the male stacking portions 38 of the wing members 30 for compatible mating engagement.

In the embodiment shown in FIG. 1A, a first connecting rod 50 is inserted along the first axis 16 through the top member 40, through each of the hinge portions 36 and center member 12 hinge portions 15. Thus, the center member 12 and one of the wing members 30 are pivotal about the rod 50. A second connecting rod 50 extends through the other hinge portion 44 of top member 40 and the hinge structure 34 of the other wing member 30.

Each of the connecting rods 50 are attached to a stud structure 52 of the hoist superstructure shown generally at 54 of FIG. 1A. This secures the hoist door assembly 10 to the building and is removable by reversing the steps above.

As will be appreciated, the wing members 30 are freely pivotable about connecting rods 50. Wing braces 58 are provided to secure the wing members 30 into position. Each wing brace 58 comprises a telescoping member and locking structure. An opening is made into the top edge of each of the wing members 30 and two openings are made in the top end zone 46 of the top member 40. The ends of the wing braces 58 are bent at approximately right angles and secured into the openings in the wing and top members. The wing braces 58 are adjusted and locked in place. The wing braces 58 aid in preventing movement of wing members 30 by the wind or other causes once they are set into the correct position.

Figures 3, 4:
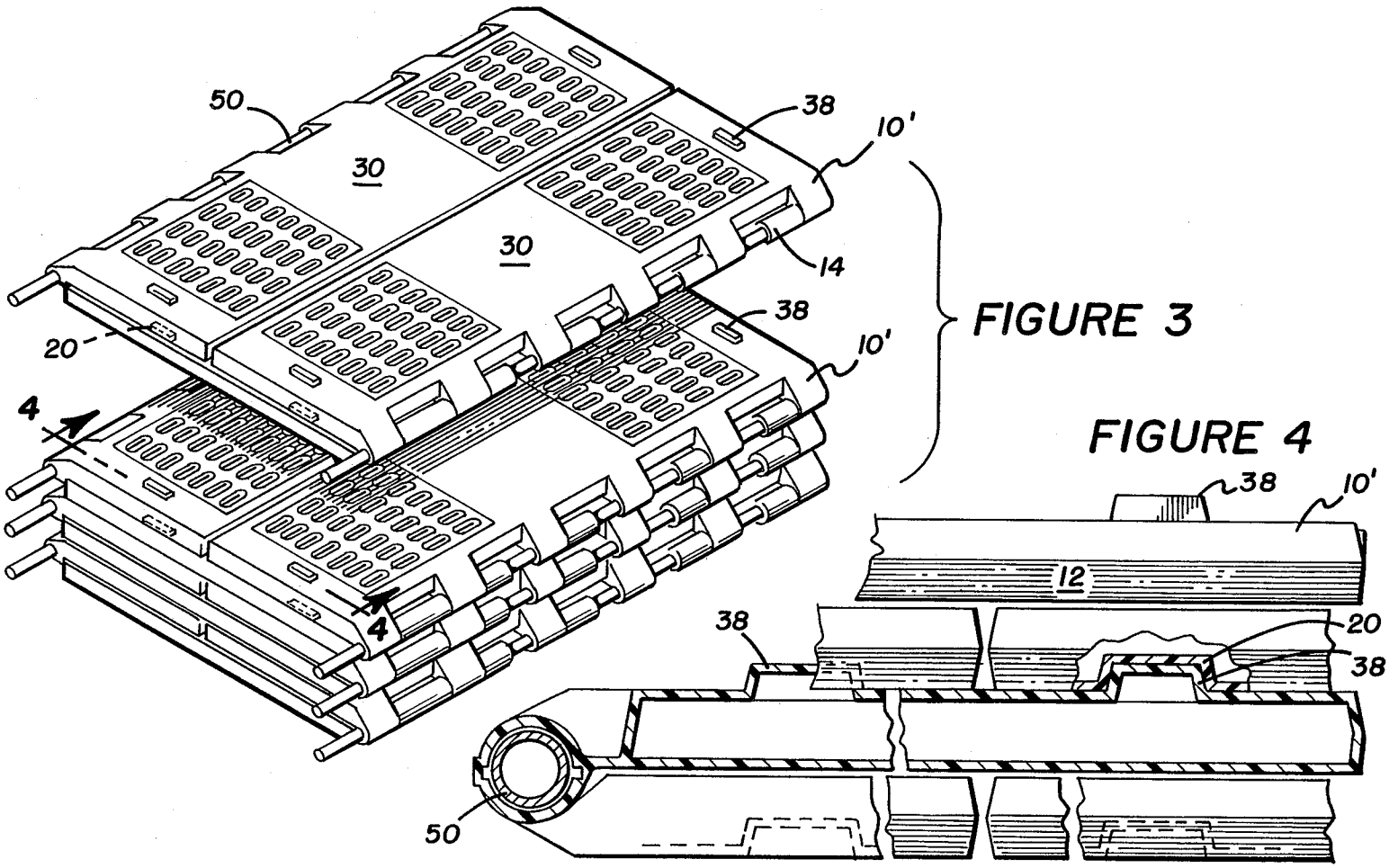
FIG. 3 is a perspective view of multiple hoist door assemblies in accordance with this invention stacked together illustrating another embodiment of the hoist assembly in accordance with this invention.
FIG. 4 is a partial sectional perspective view of FIG. 3 taken along line 4—4 of FIG. 3 and looking in the direction of the arrows.

Each of the wing members 30 pivots in the direction of the arrows 56 until making contact with the back side of the center member 12 in the folded position as more clearly shown in FIGS. 3 and 4. After the members 30 are folded together, multiple hoist door assemblies 10 can be stocked and stored or moved to another location.

With particular reference to FIG. 2, there is shown another configuration of the hoist door structure 10 with the wing members 30 generally parallel to the plane of the center member 12 instead of generally perpendicular as shown in FIG. 1. FIG. 2 illustrates the hoist door assembly 10 in use. As shown the workman can not access the door latch 26 because a cover plate 60 covers it. The latch 26 is accessible only from the side of the man lift, else a hazardous situation could be created.

FIG. 2 also illustrates the top braces 62 in position for securely holding the hoist door assembly 10 in place. A tubular portion 64 of top braces 62 are fitted into the top member hinge portion 44 along first and second axis, 16 and 18, respectively. A head portion 66 comprises an angle member which extends from the tubular portion 64 and its top surface contacts and mates with the building superstructure. After the hoist door assembly 10 has been put in place and leveled, the top braces 62 are brought into firm mating contact with the building superstructure and locked in place.

FIGS. 3 and 4 illustrate another embodiment of the hoist door assembly 10' in accordance with this invention stacked upon one another. The embodiment shown in FIGS. 3 and 4 differs from the earlier embodiment 10 only because embodiment 10' does not have a top member. It will be appreciated that the folding and stacking description set forth herein is equally applicable to the earlier embodiment 10.

A plurality of hoist door assemblies 10' are stacked upon one another with the male stacking portions 38 of the wing members 30 mating snugly with female stacking portions 20 as shown in FIG. 4. It will be appreciated that the connecting rods 50 help to secure the wing members 30 and center member 12 within the stack. However, as can be clearly seen from FIG. 3, only one side of the center member 12 has a hinge structure 14 and the other side is secured by its own female stacking portions 20 and the male stacking portions 38 of the adjacent hoist door assembly 10'. It is preferred to stack the center member 12 with the hinge structure 14 alternating from one side to the other as shown in FIG. 3. This adds stability and strength to the stacked structure as a whole.

Figures 5, 6:
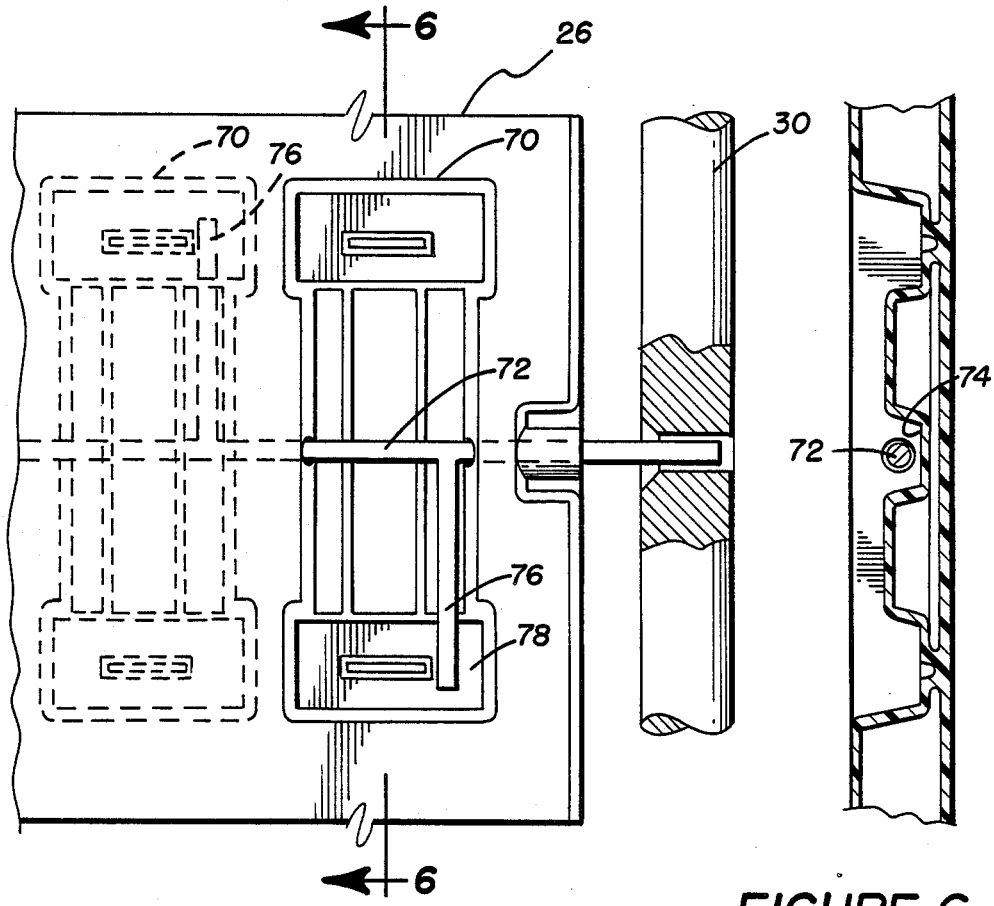
FIG. 6 is a cross-sectional plan view of FIG. 5 taken along line 6–6 of FIG. 5 and looking in the direction of the arrows.

The preferred latch 26 will now be described with reference to FIGS. 5 and 6. The latch 26 includes a locking rod 72 which slides into and out of the side member 30 for locking and unlocking the door. The latch includes side by side latchways 70. Each of the latchways 70 has a depression 74 for facilitating the sliding of the locking rod 72. The locking rod 72 has a pair of handles 76 which are accessible from either side of center member 12. The handles 76 are 180° apart on the rod so that as one of the handles 76 is used to latch and unlatch the other handle does not block its movement. Each of the latchways 70 also has a handle seat 78 where the handles 76 rest.

In the preferred embodiment, all of the members including the top, center and wing member are made from polypropelyne and they may be made from an engineering plastic. Using this material the weight of the assemblies in accordance with this invention is substantially reduced. The assembly in accordance with this invention may weigh only 130 pounds.

While the foregoing detailed description has described two embodiments of the hoist door assembly in accordance with this invention, it is to be understood that the above description is illustrative only and not limiting of the disclosed invention. Particularly, the side members need not be identical as long as they are interchangeable and the width of each of the side members need not be approximately ½W. It will be appreciated that different embodiments of the stacking portions are possible within the scope of the instant invention. Thus the invention is to be limited only by the claims as set forth below.

What is claimed is:

1. A stackable hoistway door structure, comprising:

a center member having a vertical centerline pivotable about a first or a second axis, the center member having latch means for latching or unlatching the center member and the center member having hinge means and stack means for stacking multiple hoist door assemblies said stack means being symmetrical along the vertical centerline; and first and second wing members, the first and second wing members having hinge means compatible with the center member hinge means for hinging the wing members on the center member, the wing members being pivotable about the first or the second axis, the wing members being able to pivot such that each wing member contacts the center member at its limit of rotation, the wing members being interchangeable, and each wing member having stack means for stacking multiple hoist door assemblies compatible with the center member stack means.

2. A hoistway door structure as set forth in claim 1, wherein the structure includes the center member having one end and only one end with an adjacent top member and the top member being connectable to each of the wing members, the top member including stack means compatible with the wing members stack means.

3. A hoistway door structure as set forth in claim 2, wherein the structure includes a wing brace means for bracing each of the wing members, and the wing brace means is connected to the top member and each of the wing members.

4. A hoistway door structure as set forth in claim 3, wherein the wing brace comprises a rod and each of the wing members and the top member have openings for accepting the wing brace rod and wherein the openings on each wing member and the openings on the top member are adjacent one another when the wing members are in contact with the center member.

5. A hoistway door structure as set forth in claim 2, wherein each of the members are made from an engineering plastic.

6. A hoistway door structure as set forth in claim 1, wherein the center member has a face and a back side and the latch means is equally accessible from either the face or the back of the center member.

7. A hoistway door structure as set forth in claim 6, wherein the center member defines a door and wherein a rod is inserted through the hinge means for connection of the members.

8. A hoistway door structure as set forth in claim 1, wherein the latch means includes side by side latchways, one of the latchways being accessible from a front side and one from a back side of the center member and the center member including a cover plate for preventing access of the latch means from one side of the center member.

9. A hoistway door structure as set forth in claim 1, wherein each of the wing members are symmetrical across a horizontal centerline when the wing member is upright.

10. A hoistway door structure as set forth in claim 9, wherein each of the wing members are identical.

11. A hoistway door structure as set forth in claim 1, wherein the center member has a width W and each wing member has a width less than W and the wing members are able to contact the center member simultaneously.

12. A hoistway door structure as set forth in claim 11, wherein each of the wing members has a width of approximately ½W and wherein each of the wing members are symmetrical across a horizontal centerline when the wing member is upright and identical.

13. A hoistway door structure as set forth in claim 1, wherein the center and wing members are non-foldable.

14. A stackable hoistway door assembly, comprising:

a center member having pivot means for pivoting about a first or a second axis, the center member having latch means for latching or unlatching the center member from either side of the center member and the center member having symmetrical stack means for stacking multiple hoist door assemblies;

first and second wing members, the first and second wing members each having pivot means for pivoting about the first or the second axis and means for interconnecting the center member pivot means, the wing members being able to pivot such that each wing member contacts the center member at the wing member's limit of rotation, each wing member having stack means for stacking multiple hoist door assemblies compatible with the center member stack means and the wing members being interchangeable; and a top member adjacent one end of the center member and spanning the distance between the wing members, the top member having connecting means for connection to each of the wing members, thereby, when assembled each of the members connect with one another and the wing members are interchangeable and the center member may be opened from either side.

15. A hoistway door assembly as set forth in claim 14, wherein the center and wing members stack means are provided for stacking together a plurality of hoist door assemblies with the stack means matingly engaged.

16. A hoistway door assembly as set forth in claim 14, wherein each of the members are made from a material in the family of engineering plastics.

17. A hoistway door assembly as set forth in claim 16, wherein the members are made from polypropelyne.

18. A hoistway door assembly as set forth in claim 12, wherein the center and wing members are non-foldable.

19. A stackable hoistway door structure, comprising:

a center member having a vertical centerline pivotable about a first or a second axis, the center member having latch means for latching or unlatching the center member and the center member having hinge means and stack means for stacking multiple hoist door assemblies, the center member without the latch means is symmetrical along the vertical centerline; and first and second wing members, the first and second wing having hinge means compatible with the center member hinge means for hinging the wing members on the center member, the members being pivotable about the first and the second axis, the wing members being able to pivot such that each wing member contacts the center member at its limit of rotation, the wing members being interchangeable, and each wing member having stack means for stacking multiple hoist door assemblies compatible with the center member stack means.

* * * * *